US008196964B2

(12) United States Patent
Kuo et al.

(10) Patent No.: US 8,196,964 B2
(45) Date of Patent: Jun. 12, 2012

(54) STICKY NOTE PAD

(75) Inventors: Tsung-Tien Kuo, Kaohsiung County (TW); Jen-Rong Liu, Kaohsiung Hsien (TW); Chin-Chung Tsai, Taipei Hsien (TW); Shih-Chin Wen, Taipei County (TW)

(73) Assignee: Taiwan Hopax Chemicals Mfg. Co., Ltd., Kaohsiung County (TW)

( * ) Notice: Subject to any disclaimer, the term of this patent is extended or adjusted under 35 U.S.C. 154(b) by 255 days.

(21) Appl. No.: 12/648,944

(22) Filed: Dec. 29, 2009

(65) Prior Publication Data

US 2011/0156381 A1 Jun. 30, 2011

(51) Int. Cl.

| | |
|---|---|
| ***B42D 1/00*** | (2006.01) |
| ***B42D 5/00*** | (2006.01) |
| ***B42D 15/00*** | (2006.01) |
| ***B42F 21/00*** | (2006.01) |

(52) U.S. Cl. ..... 283/38; 281/2; 281/5; 281/15.1; 283/36; 283/37; 283/39; 283/40; 283/41; 283/42; 283/43; 283/61; 283/62; 283/63.1; 283/81

(58) Field of Classification Search ..... 281/2, 5, 281/15.1; 283/36, 37, 38, 39, 40, 41, 42, 283/43, 61, 62, 63.1, 81

See application file for complete search history.

(56) References Cited

U.S. PATENT DOCUMENTS

| | | | | |
|---|---|---|---|---|
| 4,667,983 | A * | 5/1987 | Spolander | 281/15.1 |
| 4,943,089 | A * | 7/1990 | Reardon | 283/81 |
| 5,334,094 | A * | 8/1994 | Armbruster et al. | 281/42 |
| 5,366,776 | A * | 11/1994 | Mertens | 283/36 |
| 5,524,998 | A * | 6/1996 | Schwartz | 281/15.1 |
| 2006/0019050 | A1 * | 1/2006 | Gilmer | 428/40.1 |

* cited by examiner

*Primary Examiner* — Edward Tolan

*Assistant Examiner* — Justin Lewis

(74) *Attorney, Agent, or Firm* — Ladas & Parry, LLP

(57) ABSTRACT

A sticky note pad includes at least two stacks of sticky note sheets. Each sticky note sheet has a note-writing region, an index tab region projecting from a right lateral edge thereof, and a removable pressure sensitive adhesive layer provided on a bottom face thereof in proximity to a left lateral edge thereof. The index tab regions of the sticky note sheets of one of the stacks are staggered with respect to the index tab regions of the sticky note sheets of the other stack in a top-to-bottom direction, and are aligned to the same in a direction parallel to the lateral edges of the sticky note sheets. A glue layer binds the left lateral edges of the sticky note sheets of all the stacks. A partition sheet is adhered to the bottom face of a lowermost sticky note sheet of an upper stack.

7 Claims, 11 Drawing Sheets

STICKY NOTE PAD

BACKGROUND OF THE INVENTION

1. Field of the Invention

This invention relates to a note pad, more particularly to a sticky note pad.

2. Description of the Related Art

A conventional sticky note pad 1 include a plurality of sticky note sheets 11 having different colors, as shown in FIGS. 1 and 2, or may include a plurality of sticky note sheets printed with different figures or letters (not shown). Each sticky note sheet 11 has a bottom face provided with a removable pressure sensitive adhesive layer (not shown). The sticky note sheets 11 are bound to each other through a glue layer 12 provided on one lateral edge thereof. Each time the sticky note pad 1 is used, a topmost one of the sticky note sheets 11 is always peeled off first. If a specific color or figure or letter of the sticky note sheet 11 is desired, and is forcibly removed from the center of the note pad 1, not only is it difficult to remove said sticky note sheet 11, but with such removal of one or more sticky note sheets 11 from the center of the note pad 1, the pad 1 will eventually collapse, as shown in FIG. 2, and the glue layer 12 will be depressed at the center, even to the point that the remaining sticky note sheets 11 may be separated from each other. Hence, use of the sticky note pad 1 is inconvenient.

If a sticky note sheet 11 is used as a book mark, it is easily hidden within the pages of a book, and thus loses its purpose. Although the sticky note sheet 11 can be exposed partially from the pages of the book, when a plurality of sticky note sheets 11 are used, it looks messy.

Referring to FIGS. 3 and 4, a self-adhesive note pad 2, as disclosed in Taiwanese Publication No. M338828, includes a plurality of multi-colored self-adhesive note sheets 21. When the sticky note sheets 21 are adhered respectively to different pages 200 of a book 20, and protrude partially and outwardly therefrom, as shown in FIG. 4, although the purpose of using the note sheets 21 as tabs can be achieved, the note sheets 21 lack a space for writing memos or notes.

SUMMARY OF THE INVENTION

Therefore, the object of the present invention is to provide a sticky note pad that is capable of overcoming the aforementioned drawbacks of the prior art.

According to this invention, a sticky note pad comprises at least two stacks of sticky note sheets, a glue layer, and a partition sheet. The stacks are disposed one upon the other. Each sticky note sheet has top and bottom faces, left and right lateral edges, a note-writing region provided on the top face, an index tab region projecting outwardly from the right lateral edge, and a removable pressure sensitive adhesive layer provided on the bottom face in proximity to the left lateral edge. The index tab regions of the sticky note sheets of one of the stacks are staggered with respect to the index tab regions of the sticky note sheets of the other stack in a top-to-bottom direction. The index tab regions of the sticky note sheets of one of the stacks are aligned to the index tab regions of the sticky note sheets of the other stack in a direction parallel to the left and right lateral edges of the sticky note sheets. The glue layer binds the left lateral edges of the sticky note sheets of all of the stacks. The partition sheet is disposed between the two stacks, and is adhered to the bottom face of a lowermost one of the sticky note sheets of an upper one of the stacks.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
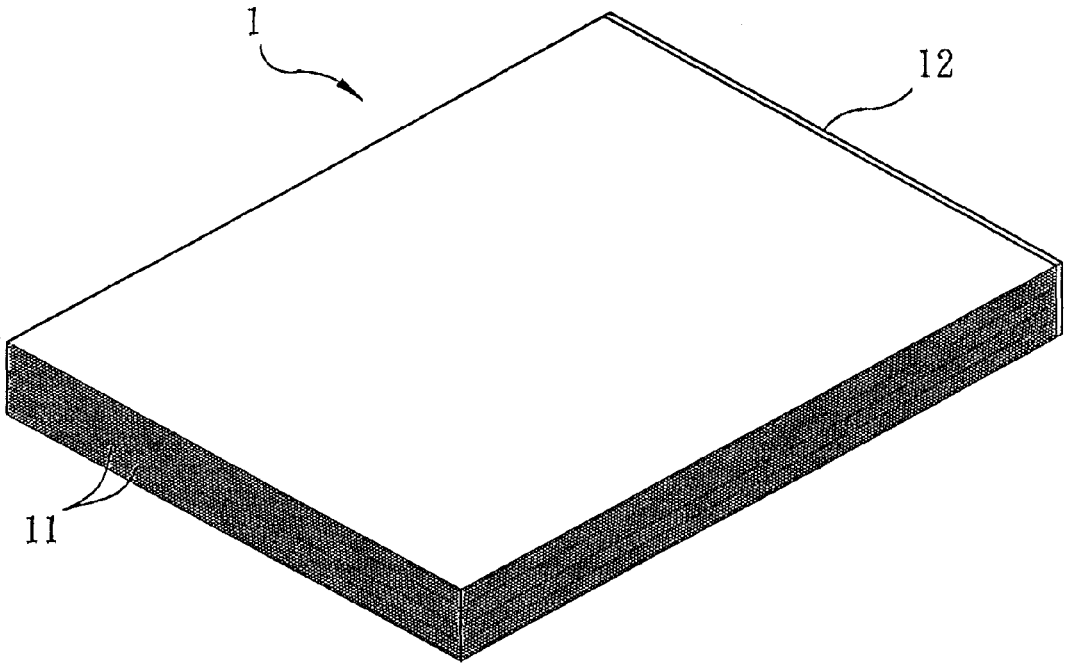
FIG. 1 PRIOR ART
FIG. 1 is a perspective view of a conventional, sticky note pad.
Figure 2:
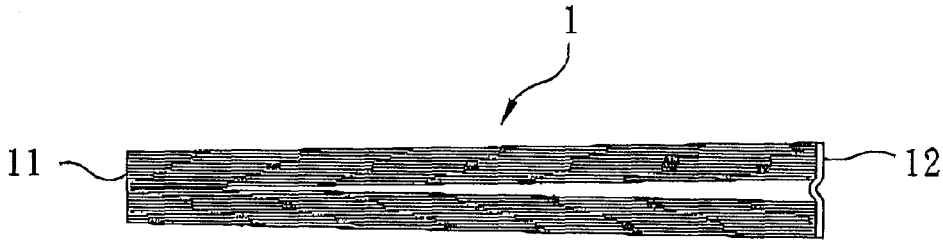
FIG. 2 PRIOR ART
FIG. 2 is a schematic side view of the conventional sticky note pad, illustrating the structure of the conventional sticky note pad after one or more sticky note sheets have been removed from the center thereof for use.
Figure 3:
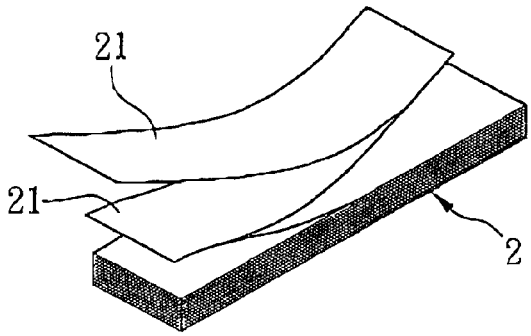
FIG. 3 PRIOR ART
FIG. 3 is a perspective view of a self-adhesive note pad disclosed in Taiwanese Publication No. M338828.
Figure 4:
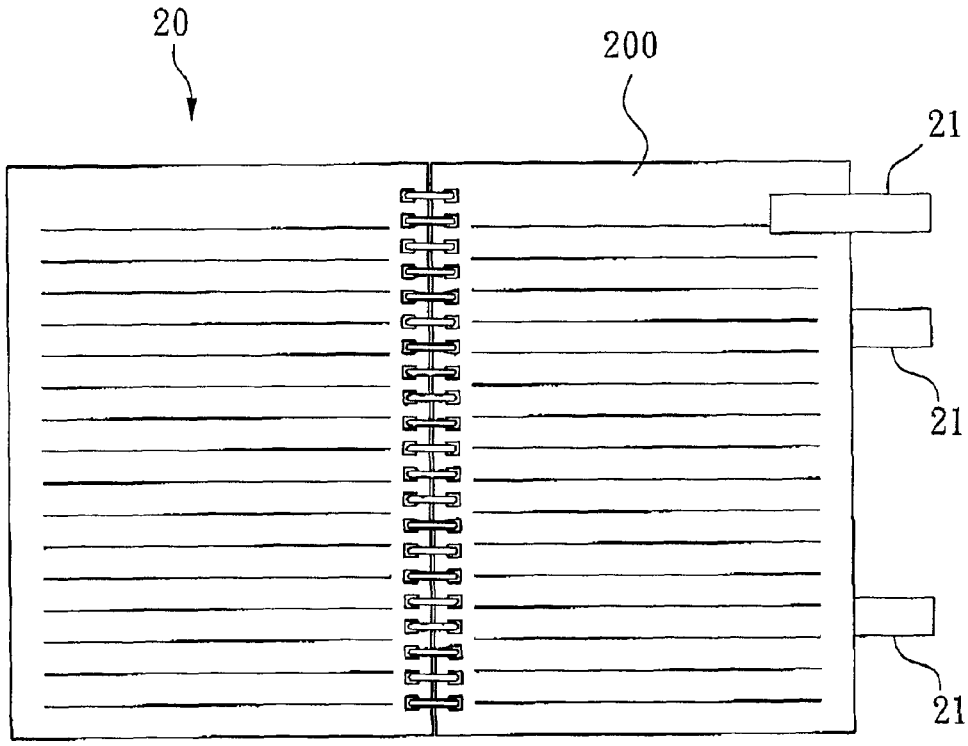
FIG. 4 PRIOR ART
FIG. 4 illustrates note sheets of the self-adhesive note pad of FIG. 3 being used as tabs of a book.
Figure 5:
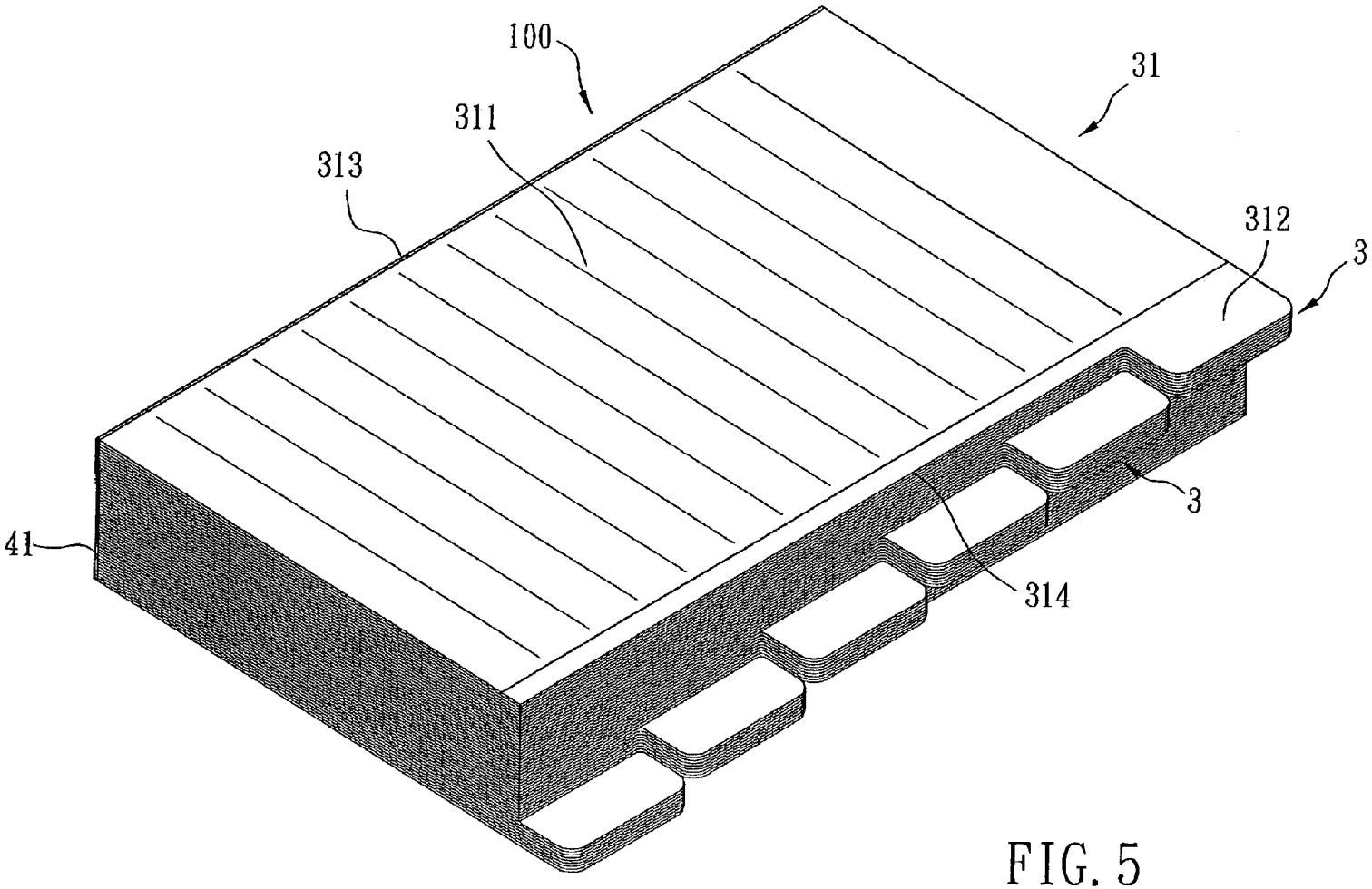
FIG. 5 is a perspective view of a sticky note pad according to the first preferred embodiment of this invention.
Figure 6:
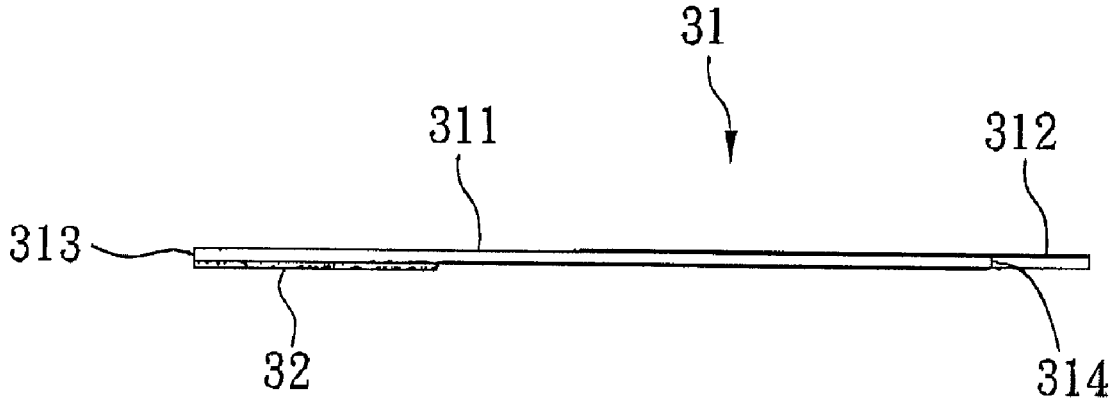
FIG. 6 is a schematic side view of a sticky note sheet of the first preferred embodiment.

Before the present invention is described in greater detail, it should be noted that the same reference numerals have been used to denote like elements throughout the specification.

Referring to FIGS. 5 to 8, a sticky note pad 100 according to the first preferred embodiment of the present invention is shown to comprise six stacks 3 of sticky note sheets 31 and a glue layer 41. The stacks 3 are disposed one upon the other. Each sticky note sheet 31 has top and bottom faces, left and right lateral edges 313, 314, a note-writing region 311 provided on the top face, an index tab region 312 projecting outwardly from the right lateral edge 314, and a removable pressure sensitive adhesive layer 32 provided on the bottom face in proximity to the left lateral edge 313. The index tab regions 312 of the sticky note sheets 31 of one of the stacks 3 is staggered with the index tab regions 312 of the sticky note sheets 31 of another one of the stacks 3 in a top-to-bottom direction, and are aligned with each other in a direction parallel to the left and right lateral edges 313, 314 of the sticky note sheets 31. In this embodiment, the index tab regions 312 of the sticky note sheets 31 of any one of the stacks 3 have the same color, which is different from the color of the index tab regions 312 of the sticky note sheets 31 of the other stacks 3. Further, the note-writing region 311 of each sticky note sheet 31 may have the same color as the index tab region 312 of a respective sticky note sheet 31, or the right lateral edge 314 of each sticky note sheet 31 may have the same color as the index tab region 312 of the respective sticky note sheet 31.

Figure 7:
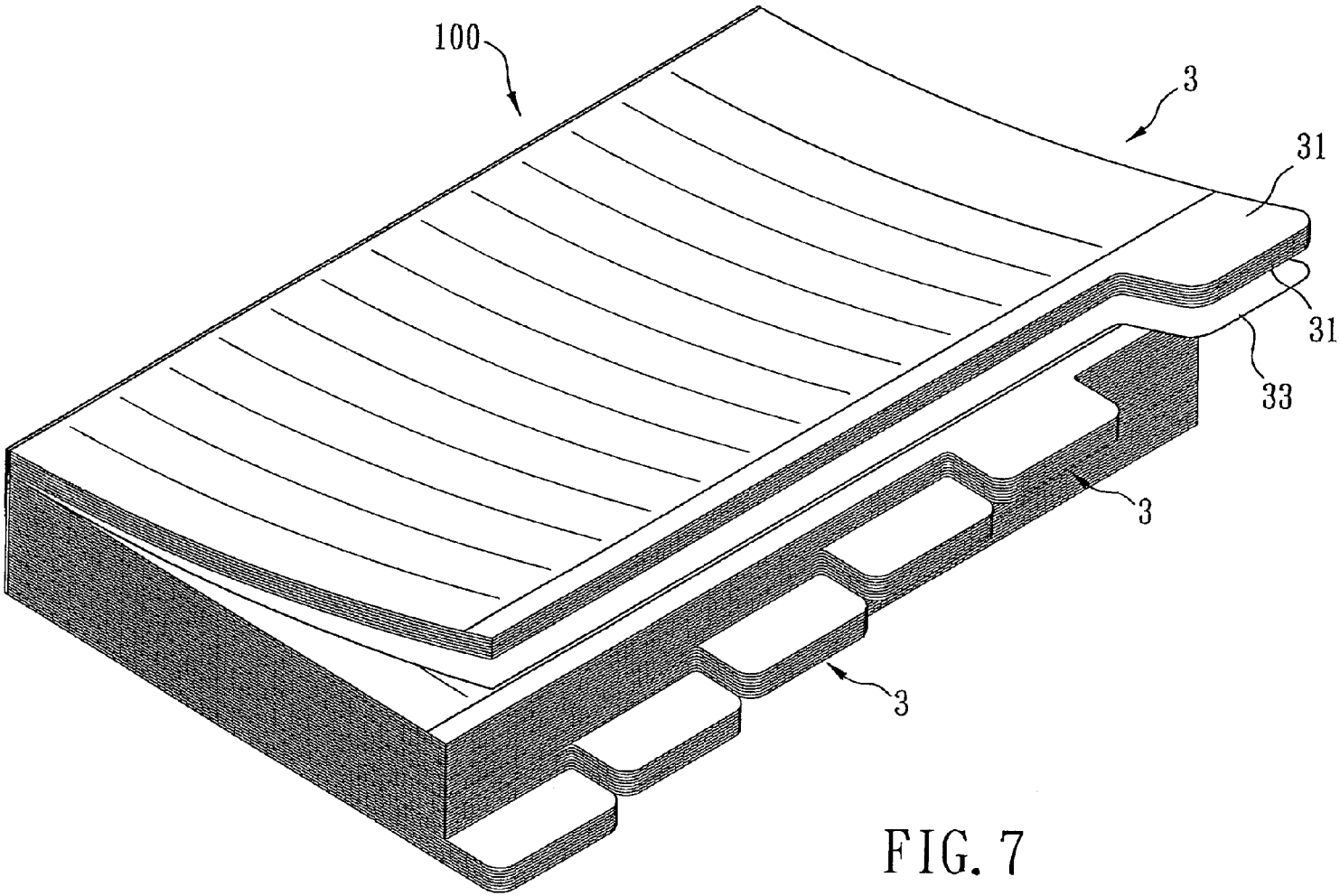
FIG. 7 is a view similar to FIG. 5, but illustrating a partition sheet of the sticky note pad.

A partition sheet 33, as shown in FIG. 7, is disposed between each two adjacent ones of the stacks 3, and is adhered to the bottom face of a lowermost one of the sticky note sheets 31 of an upper one of the stacks 3. Hence, when two adjacent ones of the stacks 3 are flipped open, the partition sheet 33 prevents the lowermost one of the sticky note sheets 31 of an upper one of the stacks 3 from adhering to an uppermost one of the sticky note sheets 31 of a lower one of the stacks 3. The glue layer 41 binds the left lateral edges 313 of the sticky note sheets of all of the stacks 3. The number of the stacks 3 of the sticky note sheets 31 is not limited to the aforesaid disclosure.

In use, when there is an important event or occasion that needs a reminder, notes may be written on the note-writing region 311 of one of the sticky note sheets 31, after which the sticky note sheet 31 with writing thereon is peeled off from the sticky note pad 100, and is adhered to an object, such as the top surface of a desk, a computer screen, a refrigerator, etc.

Further, the sticky note pad 100 may serve as a notebook, i.e., notes may be written down on the note-writing region 311 of each sticky note sheet 31, and the index tab region 312 of each sticky note 31 may be labeled, for example, work, home, friends, etc.

Figure 8:
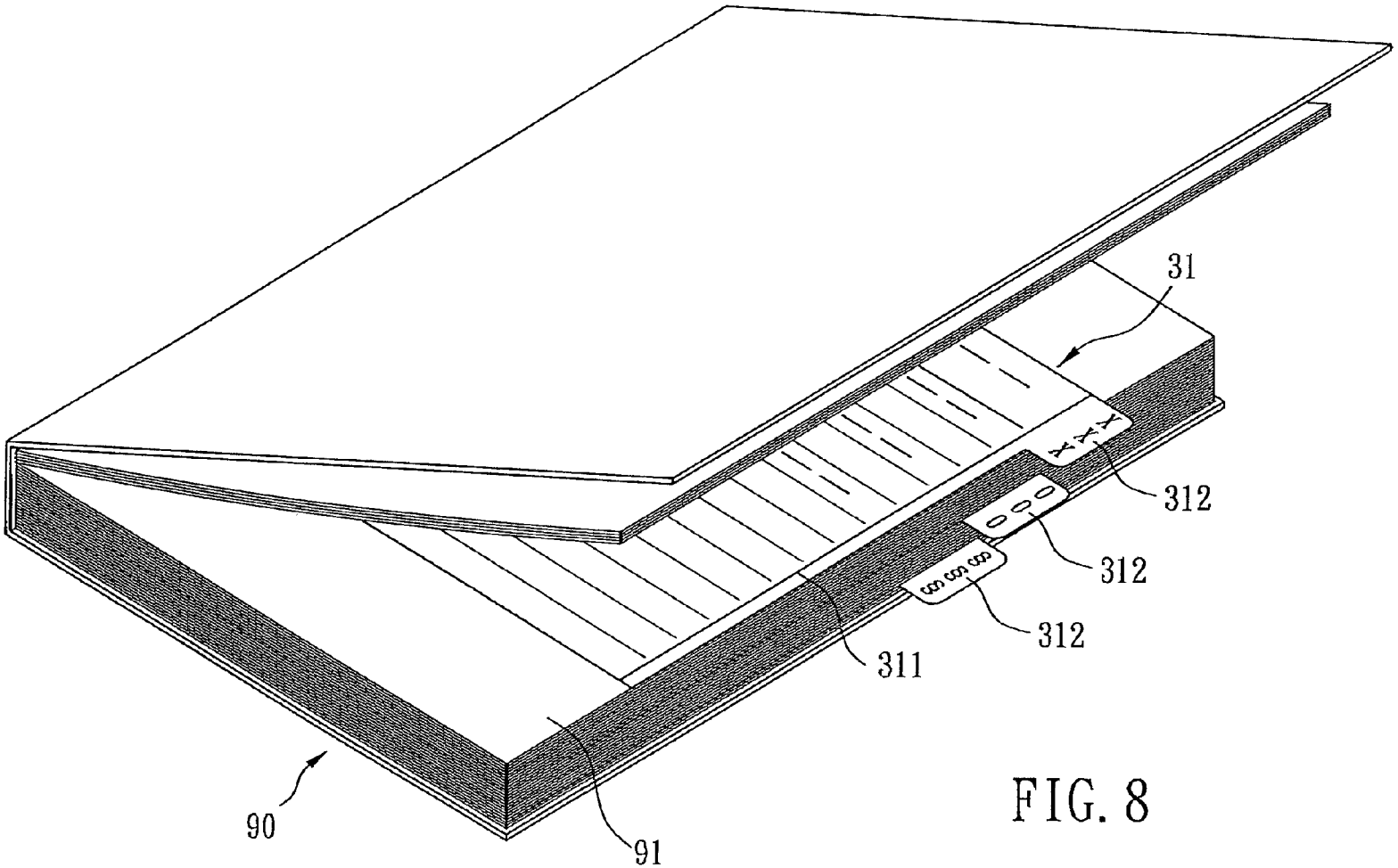
FIG. 8 illustrates the first preferred embodiment in a state of use.

Moreover, with reference to FIG. 8, when reading a book 90, an excerpt therefrom or a note may be written down on the note-writing region 311 of one of the sticky note sheets 31, and the index tab region 312 may be labeled with a keyword to facilitate searching. The written sticky note sheet 31 may then be peeled off and adhered to a page 91 of the book 90 such that the index tab region 312 appears outwardly of the page 91. Each sticky note sheet 31 not only has enough space for writing notes through provision of the note-writing region 311, but also has the index tab region 312 that appears outwardly of the page 91 for marking and classifying the notes. An appealing appearance of the entire book 90 may thus be maintained.

Figure 9:
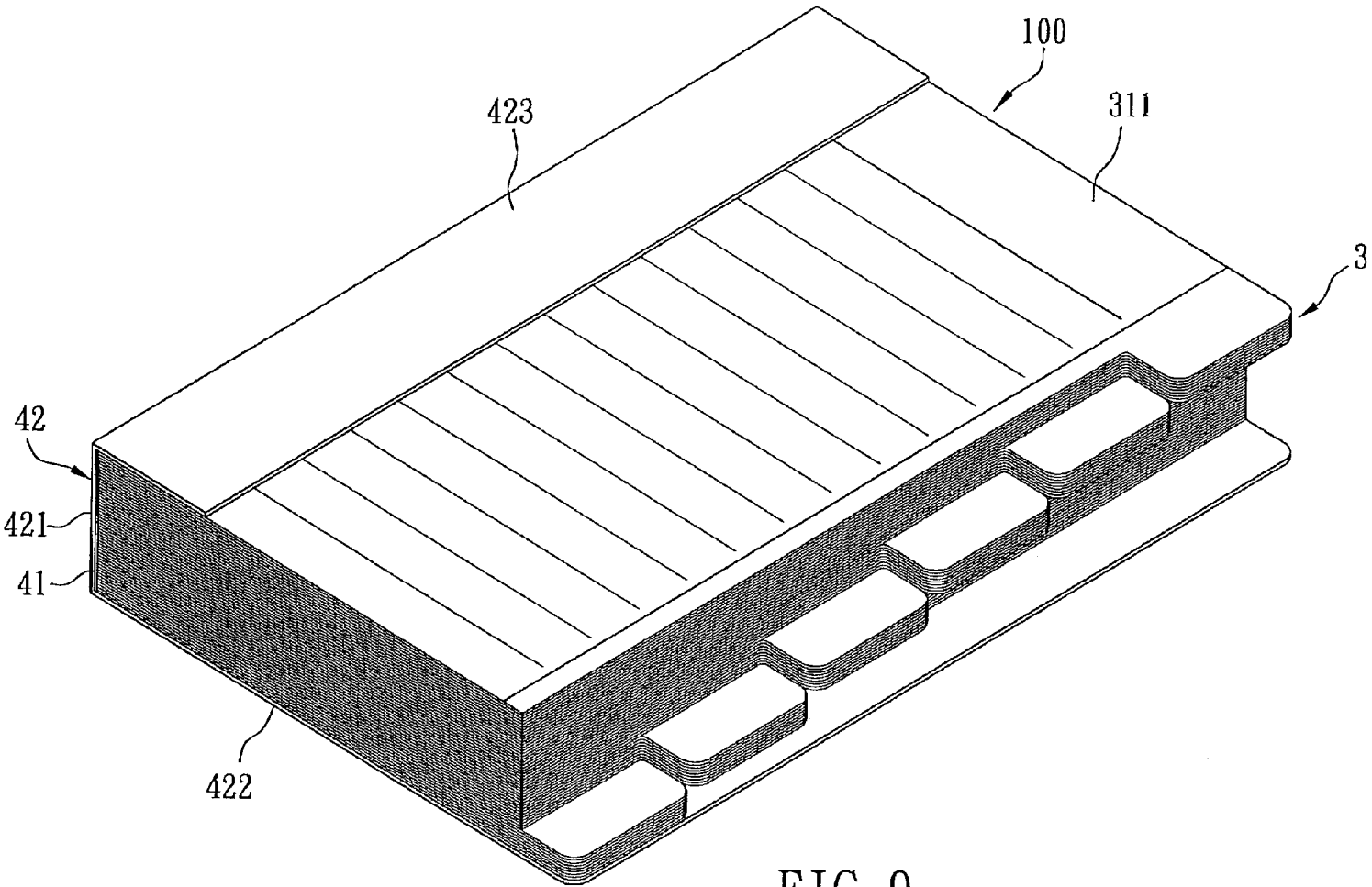
FIG. 9 is a perspective view of a sticky note pad according to the second preferred embodiment of this invention.
Figure 10:
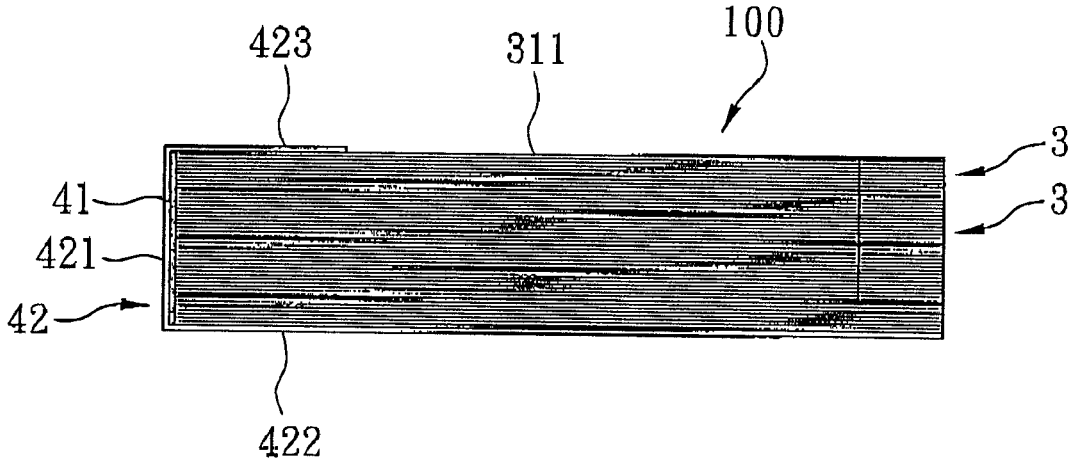
FIG. 10 is a schematic side view of the second preferred embodiment.

Referring to FIGS. 9 and 10, a sticky note pad 100 according to the second preferred embodiment of the present invention is shown to be similar to the first preferred embodiment. However, in this embodiment, the sticky note pad 100 further comprises a protective layer 42 having a lateral shield section 421 adhered to the glue layer 41, a bottom shield section 422 connected integrally as one piece with a bottom end of the lateral shield section 421 and disposed below a lowermost one of the sticky note sheets 31 of a lowermost one of the stacks 3, and a top shield section 423 connected integrally as one piece with a top end of the lateral shield section 421 and disposed above an uppermost one of the sticky note sheets of an uppermost one of the stacks 3. The top shield section 423 covers a portion of the note-writing region 311 of the uppermost one of the sticky note sheets 31 of the uppermost one of the stacks 3. The sticky note pad 100 of the second preferred embodiment not only can achieve the advantages described in the first preferred embodiment, but also the entire structure of the sticky note pad 100 is stabilized through the presence of the protective layer 42, and the glue layer 41 can be covered by the protective layer 42, so that the appearance of the entire sticky note pad 100 can be enhanced.

Figure 11:
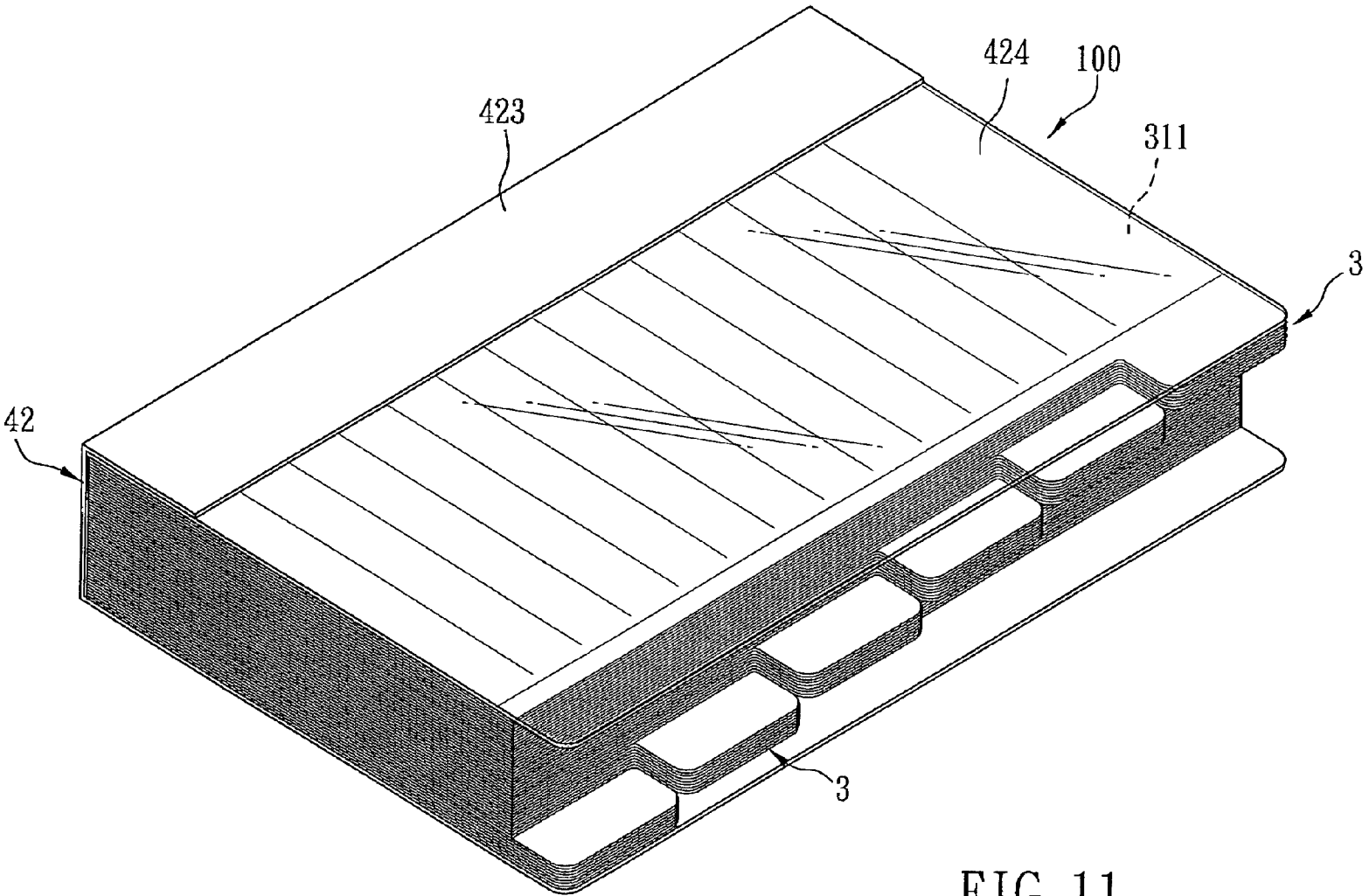
FIG. 11 is a perspective view of a sticky note pad according to the third preferred embodiment of this invention.
Figure 12:
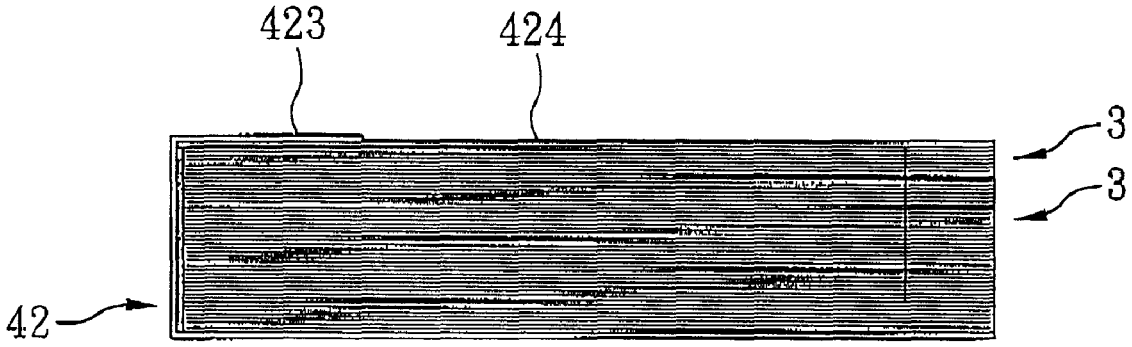
FIG. 12 is a schematic side view of the third preferred embodiment.

Referring to FIGS. 11 and 12, a sticky note pad 100 according to the third preferred embodiment of the present invention is shown to be similar to the second preferred embodiment. However, in this embodiment, the sticky note pad 100 further comprises a transparent cover sheet 424 connected to the top shield section 423 and covering the remaining portion of the note-writing region 311 of the uppermost one of the sticky note sheets 31 of the uppermost one of the stacks 3, thereby providing an additional layer of protection to the sticky note pad 100. Hence, damage to and sullying of the sticky note pad 100 can be prevented.

Figure 13:
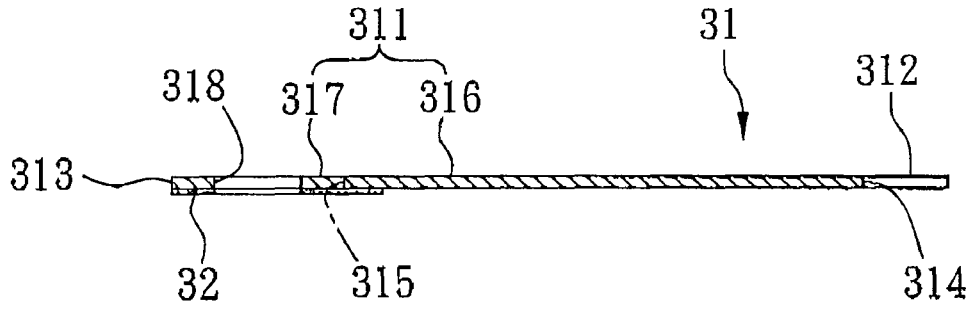
FIG. 13 is a sectional view of a sticky note sheet of a sticky note pad according to the fourth preferred embodiment of this invention.
Figure 14:
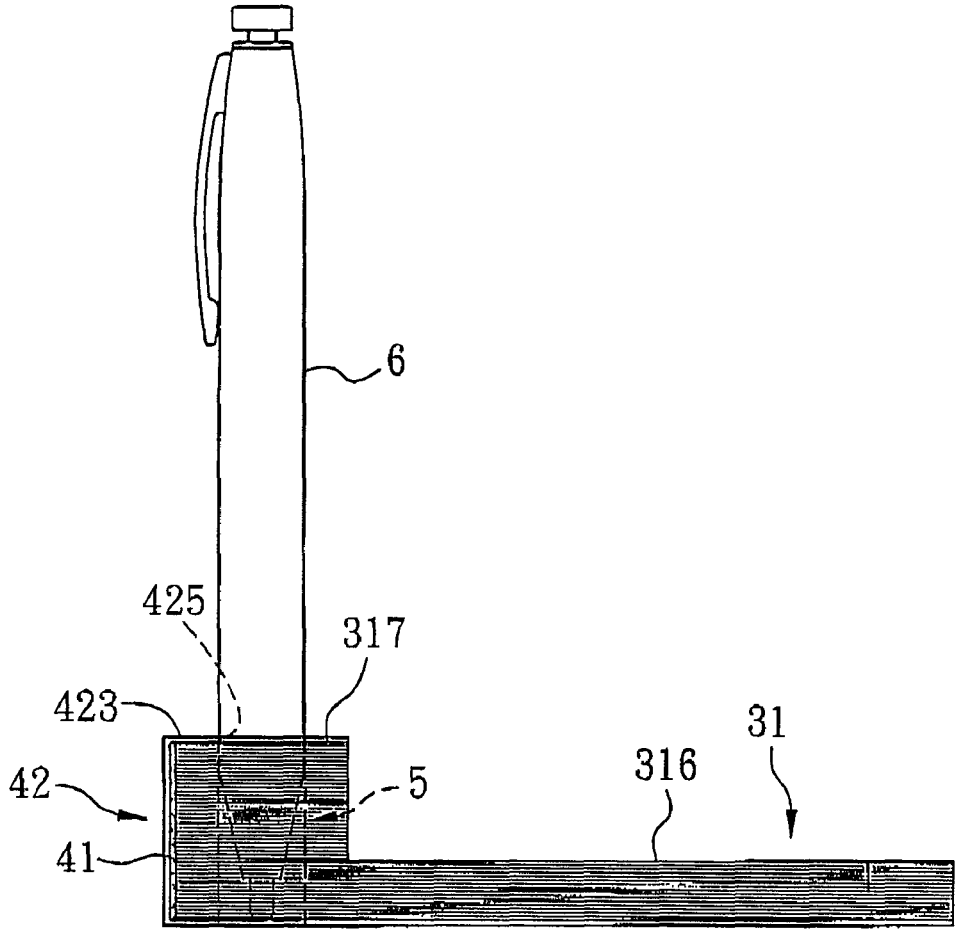
FIG. 14 is a schematic side view of the fourth preferred embodiment in a state of use.

Referring to FIGS. 13 and 14, a sticky note pad 100 according to the fourth preferred embodiment of the present invention is shown to be similar to the second preferred embodiment. However, in this embodiment, the note-writing region 311 of each sticky note sheet 31 is divided by a weak line 315 into a removable part 316 which is distal from the left lateral edge 313, and a non-removable part 317 which is proximate to the left lateral edge 313 and which is formed with a first through hole 318. The removable pressure sensitive adhesive layer 32 of each sticky note sheet 31 is applied to the non-removable part 317 and a portion of the removable part 316. The top shield section 423 of the protective layer 42 is formed with a second through hole 425 aligned with the first through hole 318. The first through holes 318 in the non-removable parts 317 of the sticky note sheets 31 and the second through hole 425 cooperatively define a pen-receiving slot 5.

In use, after a note is written on the removable part 316 of the sticky note sheet 31, the sticky note sheet 31 is lightly peeled off along the weak line 315 so as to separate the removable part 316 from the non-removable part 317, and is then adhered to a desired object through the removable pressure sensitive adhesive layer 32 to serve as a reminder. The non-removable part 317 of the peeled sticky note sheet 31 remains adhered to the non-removable part 317 of an adjacent sticky note sheet 31 through the removable pressure sensitive adhesive layer 32. As shown in FIG. 14, even when a large portion of the removable parts 316 of the sticky note sheets 31 are peeled off, a pen 6 can still be placed in the pen-receiving slot 5. Hence, use of the sticky note sheet 31 is convenient. Further, the pen-receiving slot 5 defined by the through hole 425 in the top shield section 423 and the through holes 318 in the non-removable parts 317 of the sticky note sheets 31 provides for greater utility of the sticky note pad 100.

From the aforesaid description, the sticky note pad 100 of the present invention may be used as a notebook with a classification function. Also, the sticky note sheets 31 can be peeled off and adhered to a desired object so as to serve as a reminder. Further, through the configuration of the index tab regions 312 of the sticky note sheets 31, when used as a book mark, the index tab regions 312 of the sticky note sheets 31 are exposed in a neat and orderly fashion from the pages 91 of the book 90, thereby maintaining an appealing appearance of the entire book 90.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

We claim:

1. A sticky note pad comprising:

at least two stacks of sticky note sheets, said stacks being disposed one upon the other, each of said sticky note sheets having top and bottom faces, left and right lateral edges, a note-writing region provided on said top face, said note-writing region having a weakened portion to define a removable and a non-removable part, an index tab region projecting outwardly from said right lateral edge; and a removable pressure sensitive adhesive layer provided on said bottom face in proximity to said left lateral edge, said index tab regions of said sticky note sheets of one of said stacks being staggered with respect to said index tab regions of said sticky note sheets of the other one of said stacks in a top-to-bottom direction, said index tab regions of said sticky note sheets of one of said stacks being aligned with said index tab regions of said sticky note sheets of the other one of said stacks in a direction parallel to said left and right lateral edges of said sticky note sheets;

a glue layer binding said left lateral edges of said sticky note sheets of all of said stacks;

a partition sheet disposed between said two stacks and adhered to said bottom face of a lowermost one of said sticky note sheets of an upper one of said stacks; and a protective layer comprising a top shield section disposed above an uppermost one of said sticky note sheets of an uppermost one of said stacks, wherein the non-removable part of each of said sticky note sheets is formed with a first through hole, said top shield section of said protective layer being formed with a second through hole aligned with said first through hole, said first through hole and said second through hole defining a pen-receiving slot.

2. The sticky note pad of claim 1, wherein said index tab regions of said sticky note sheets of one of said stacks are colored differently from said index tab regions of said sticky note sheets of the other one of said stacks.

3. The sticky note pad of claim 1, wherein said index tab region of each of said sticky note sheets is colored the same as said right lateral edge of a respective one of said sticky note sheets.

4. The sticky note pad of claim 1, wherein said sticky note pad comprises six said stacks of said sticky note sheets.

5. The sticky note pad of claim 4, wherein the protective layer further comprises a lateral shield section adhered to said glue layer, a bottom shield section connected integrally as one piece with a bottom end of said lateral shield section and disposed below a lowermost one of said sticky note sheets of a lowermost one of said stacks, and the top shield section is connected integrally as one piece with a top end of said lateral shield section, said top shield section covering a portion of said note-writing region of said uppermost one of said sticky note sheets of said uppermost one of said stacks.

6. The sticky note pad of claim 5, further comprising a transparent cover sheet connected to said top shield section and covering the remaining portion of said note-writing region of said uppermost one of said sticky note sheets of said uppermost one of said stacks.

7. The sticky note pad of claim 5, wherein the removable part is distal from said left lateral edge, and the non-removable part is proximate to said left lateral edge, said removable pressure sensitive adhesive layer of each of said sticky note sheets being applied to said non-removable part and a portion of said removable part.

* * * * *